US009784479B2

(12) United States Patent
Xu et al.

(10) Patent No.: US 9,784,479 B2
(45) Date of Patent: Oct. 10, 2017

(54) CRYOGENIC REFRIGERATOR AND DISPLACER

(71) Applicant: Sumitomo Heavy Industries, Ltd., Tokyo (JP)

(72) Inventors: Mingyao Xu, Tokyo (JP); Takaaki Morie, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 336 days.

(21) Appl. No.: 13/915,982

(22) Filed: Jun. 12, 2013

(65) Prior Publication Data

US 2013/0327065 A1 Dec. 12, 2013

(30) Foreign Application Priority Data

Jun. 12, 2012 (JP) ..... 2012-133265

(51) Int. Cl.
*F25B 9/00* (2006.01)
*F25B 9/14* (2006.01)

(52) U.S. Cl.
CPC ..... *F25B 9/00* (2013.01); *F25B 9/14* (2013.01)

(58) Field of Classification Search
CPC ..... F25B 9/00; F25B 9/14
USPC ..... 62/6
See application file for complete search history.

(56) References Cited

U.S. PATENT DOCUMENTS 4,848,092 A * 7/1989 Gifford ..... F25B 9/14 123/41.69
5,092,130 A * 3/1992 Nagao ..... F25B 9/14 165/4
5,398,511 A * 3/1995 Inaguchi ..... F25B 9/14 62/6
5,447,034 A * 9/1995 Kuriyama ..... F16J 9/062 148/301
5,481,879 A * 1/1996 Asami ..... F25B 9/14 62/6
6,216,467 B1 * 4/2001 O'Neil ..... F25B 9/14 62/6
6,532,748 B1 * 3/2003 Yuan ..... F02G 1/0435 165/10

(Continued)

FOREIGN PATENT DOCUMENTS

JP 2011-017457 A 1/2011

OTHER PUBLICATIONS

JP 2011-17457 Translation, Otani.*

*Primary Examiner* — Frantz Jules
*Assistant Examiner* — Brian King
(74) *Attorney, Agent, or Firm* — Michael Best & Friedrich LLP

(57) ABSTRACT

A cryogenic refrigerator includes a displacer having a flow channel that supplies a refrigerant gas to a regenerator; and a cylinder that accommodates the displacer so as to be movable in an axial direction, has a heat diffusion portion at a high-temperature end portion thereof, and forms a space portion together with a high-temperature end of the displacer. A clearance is formed between an outer peripheral surface of the displacer and an inner peripheral surface of the cylinder. The flow channel is made to open to the outer peripheral surface of the displacer, and the refrigerant gas within the room-temperature chamber flows into the regenerator through the clearance and the flow channel.

7 Claims, 3 Drawing Sheets

(56) References Cited

U.S. PATENT DOCUMENTS

| | | | | |
|---|---|---|---|---|
| 2002/0026799 | A1* | 3/2002 | Okamura | C09K 5/14 62/6 |
| 2007/0261418 | A1* | 11/2007 | Nun | F25B 9/14 62/6 |

* cited by examiner

CRYOGENIC REFRIGERATOR AND DISPLACER

INCORPORATION BY REFERENCE

Priority is claimed on Japanese Patent Application No. 2012-133265, filed Jun. 12, 2012, the entire content of which is incorporated herein by reference.

BACKGROUND

Technical Field

The present invention relates to a cryogenic refrigerator that generates cryogenic refrigeration using a high-pressure refrigerant gas supplied from a compression device, and a displacer used for the cryogenic refrigerator.

Description of the Related Art

Generally, a refrigerator (GM refrigerator) using a Gifford-McMahon cycle as a small-sized refrigerator for obtaining a cryogenic environment is known in the related art. In the GM refrigerator, supply and exhaust of a refrigerant gas (working fluid) compressed in a compressor are periodically performed by opening and closing of a valve.

In the GM refrigerator, a high-pressure refrigerant gas supplied from the compressor is first introduced into a room-temperature space (room-temperature chamber) provided on a high-temperature side within a cylinder, and is then introduced into an expansion space formed at a low-temperature end through a regenerator in the displacer from the room-temperature chamber. Then, cooling is generated as the refrigeration expands in the expansion space.

SUMMARY

According to an embodiment of the present invention, there is provided a cryogenic refrigerator including a displacer having a flow channel that supplies a refrigerant gas to a stored regenerator; and a cylinder that accommodates the displacer so as to be movable in an axial direction, has a heat diffusion portion at a high-temperature end portion thereof, and forms a space portion together with a high-temperature end of the displacer. Here, a clearance is formed between an outer peripheral surface of the displacer and an inner peripheral surface of the cylinder, the flow channel is made to open to the outer peripheral surface of the displacer, and the refrigerant gas within the space portion flows into the regenerator through the clearance and the flow channel.

DETAILED DESCRIPTION

Generally, since the inside of the regenerator is filled with a regenerative material, a flow channel resistance when the refrigerant gas flows through the regenerator is larger than a flow channel resistance when the refrigerant gas flows from the compressor to the room-temperature chamber. The refrigerant gas is compressed in the room-temperature space due to a difference of the flow channel resistances, and there is a concern that the temperature of the refrigerant gas may rise because of the compression heat.

In the GM refrigerator of the related art, since the refrigerant gas with a high temperature flows into the regenerator as it is from the room-temperature space, the refrigerant gas whose temperature has risen by the compression in the room-temperature space flows into the regenerator, and thereby, there is a concern that cooling efficiency may be degraded.

It is desirable to provide a cryogenic refrigerator and a displacer that improves cooling efficiency.

According to the disclosed invention, since the refrigerant gas in the space portion flows into the regenerator through the clearance, heat exchange is performed between the outer peripheral surface of the displacer and the inner peripheral surface of the cylinder that form the clearance to cool the refrigerant gas. Thereby, the temperature of the refrigerant gas that flows into the regenerator can be lowered, and the refrigeration efficiency of the cryogenic refrigerator can be enhanced.

Next, embodiments of the invention will be described together with drawings.

Figure 1:
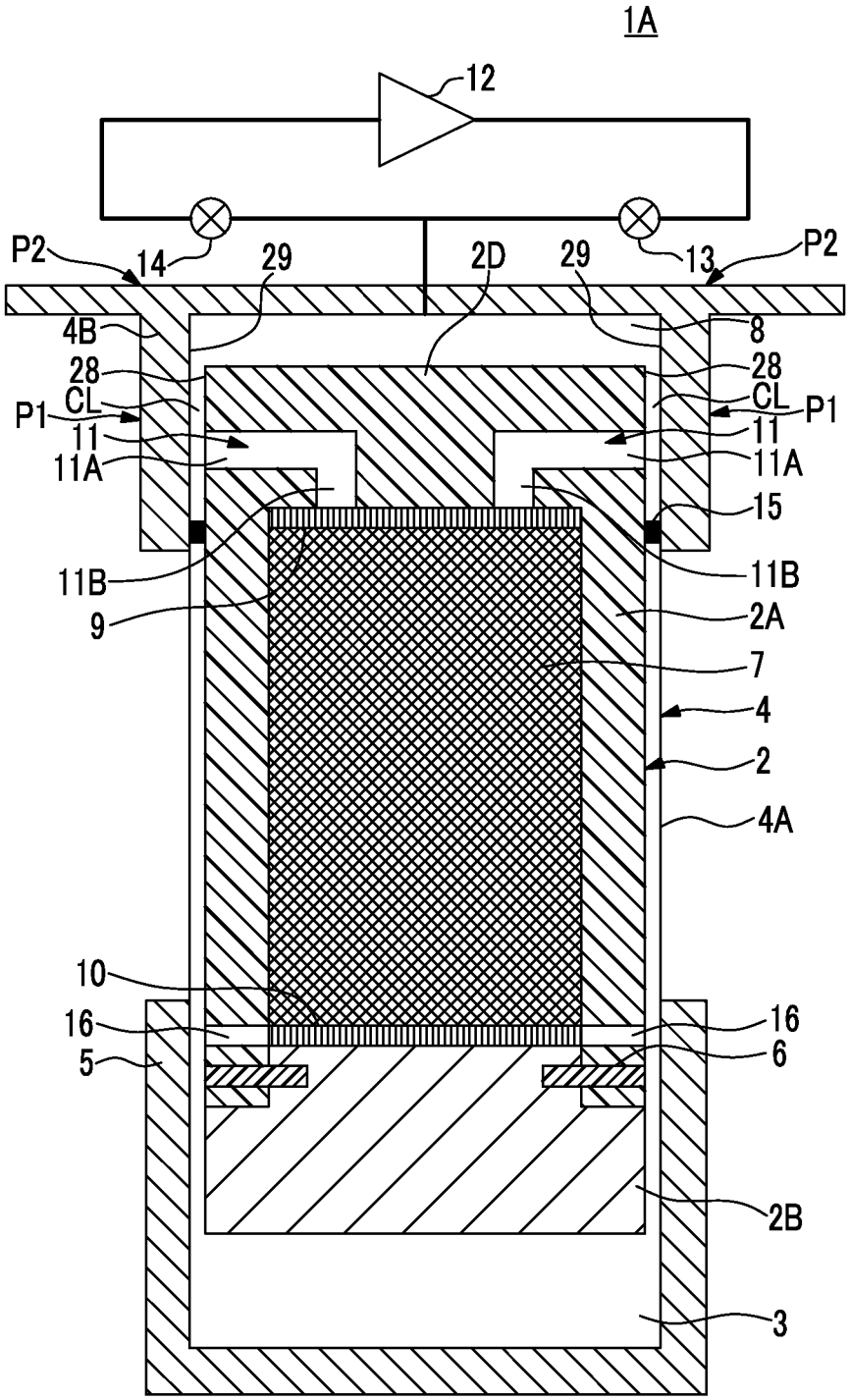
FIG. 1 is a cross-sectional view of a cryogenic refrigerator and a displacer according to one embodiment of the invention.

FIG. 1 shows a cryogenic refrigerator 1A according to one embodiment of the invention. Although the cryogenic refrigerator 1A related to the present embodiment is described taking as an example with a Gifford McMahon (GM) type refrigerator that uses a helium gas as a refrigerant gas, application of the invention is not limited to the GM refrigerator and application can also be made to various refrigerators that have a displacer. Additionally, although a one-stage type refrigerator is illustrated as the cryogenic refrigerator 1A in the present embodiment, application can also be made to a multi-stage type refrigerator.

The cryogenic refrigerator 1A has a displacer 2, a cylinder 4, a cooling stage 5, a regenerator 7, a compressor 12, and the like.

The displacer 2 is configured so as to have a displacer body 2A (equivalent to a body portion described in the claims), a low-temperature-side heat conduction portion 2B, the regenerator 7, and the like. The displacer body 2A has a bottom tubular shape, and the regenerator 7 in which a regenerative material is stored is provided inside the displacer body.

As for the displacer body 2A, for example, materials with a low heat conductivity, such as Bakelite (registered trademark), are used in order to reduce heat transfer in an axial direction.

A flow-straightener 9 that straightens the flow of the refrigerant gas is provided on a high-temperature side (the upper side becomes the high-temperature side in the drawing) of the regenerator 7. Additionally, a flow-straightener 10 that straightens the flow of the refrigerant gas is also provided on a low-temperature side (the lower side becomes the low-temperature side in the drawing) of the regenerator 7.

A plurality of first flow channels 11 for allowing the refrigerant gas to flow into the regenerator 7 from a room-temperature chamber 8 (equivalent to a space portion described in the claims) are formed in an upper plate portion 2D located at a high-temperature end of the displacer 2. The room-temperature chamber 8 is a space that is formed between the cylinder 4 and the upper plate portion 2D of the displacer 2.

An intake/exhaust system is connected to the room-temperature chamber 8. The intake/exhaust system has the compressor 12, a supply valve 13, a return valve 14, and the like. As the return valve 14 is closed simultaneously when the supply valve 13 is opened, a high-pressure refrigerant gas generated by the compressor 12 is supplied to the room-temperature chamber 8. On the contrary, as the return valve 14 is opened simultaneously when the supply valve 13 is closed, a low-pressure refrigerant gas flows back to the compressor 12.

The low-temperature-side heat conduction portion 2B is provided at a low-temperature end of the displacer 2. Additionally, a second flow channel 16 that allows the regenerator 7 and an expansion space 3 to communicate with each other is formed between the displacer body 2A and the low-temperature-side heat conduction portion 2B. The low-temperature-side heat conduction portion 2B is combined with the displacer body 2A using a pin 6.

The expansion space 3 is a space formed by the cylinder 4 and the displacer 2. The high-pressure refrigerant gas is introduced into the expansion space 3. As the return valve 14 is opened when the volume of the expansion space 3 becomes substantially the maximum along with the movement of the displacer 2, the refrigerant gas expands adiabatically, and cooling is generated in the expansion space 3.

The cooling stage 5 is provided at a position corresponding to the expansion space 3 of the cylinder 4. The cooling stage 5 is thermally connected to an object to be cooled, and the object to be cooled is cooled via the cooling stage 5.

The cylinder 4 accommodates the displacer 2 therein in a movable manner. A scotch yoke mechanism that is not shown is connected to the high-temperature end of the displacer 2. Hence, the displacer 2 reciprocally moves within the cylinder 4 by the scotch yoke mechanism.

The cylinder 4 has a cylinder body 4A and a top flange 4B for fixing a cylinder body 4A. The cylinder body 4A has a cylindrical shape, has the cooling stage 5 arranged at a low-temperature end portion thereof, has the top flange 4B arranged at a high-temperature end portion thereof. The aforementioned room-temperature chamber 8 is formed between the top flange 4B and the upper plate portion 2D of the displacer 2.

The cylinder body 4A is formed of stainless steel. Additionally, the top flange 4B is formed of the same material as that of the cylinder 4, such as stainless steel, or materials, such as copper and aluminum having higher heat transfer efficiency than this material.

Additionally, a clearance CL is formed between an outer peripheral surface 28 of the displacer 2 and an inner peripheral surface 29 of the cylinder 4 (top flange 4B). The clearance CL is, for example, a gap of about 0.1 mm to about 1.0 mm.

Additionally, the cylinder 4 has a heat transfer portion P1 and a heat diffusion portion P2. The heat transfer portion P1 is provided at a position corresponding to the clearance CL in the outer periphery of the cylinder 4. The heat transfer portion P1 is a member that transfers heat to the heat diffusion portion P2 (a top plate portion of the top flange 4B in the present embodiment).

The heat diffusion portion P2 is a member for releasing the heat transferred via the heat transfer portion P1 from the refrigerant gas that flows through the clearance CL to the outside of the cylinder 4. As the configuration of the heat transfer portion P1, for example, a configuration can be adopted in which a plate made of the same material as that of the cylinder 4, such as stainless steel, or a plate made of materials, such as copper and aluminum having higher heat transfer efficiency than the material of the cylinder is wound around the outer periphery of the cylinder 4. Additionally, the heat transfer portion P1 may be configured by making the thickness of cylinder 4 itself corresponding to the heat transfer portion P1 larger than thicknesses at other positions. Moreover, the heat diffusion portion P2 can also be integrated with the top flange 4B. The present embodiment shows an example in which the top flange 4B that constitutes the cylinder 4 and the heat diffusion portion P2 are integrated with each other.

A seal 15 is mounted at a predetermined position between the displacer 2 (displacer body 2A) and the top flange 4B. The seal 15 prevents the refrigerant gas supplied from the compressor 12 from flowing into the expansion space 3 via the clearance CL.

Next, the operation of the cryogenic refrigerator 1A configured as above will be described.

If the displacer 2 opens the supply valve 13 in a case where the cylinder 4 has moved downward, the high-pressure refrigerant gas generated by the compressor 12 is supplied to the room-temperature chamber 8. Then, the displacer 2 is moved upward while maintaining the supply of the high-pressure refrigerant gas from the compressor 12. Thereby, the high-pressure refrigerant gas within the room-temperature chamber 8 flows into the regenerator 7 through the first flow channel 11 from the clearance CL.

In this case, since the flow channel resistance when the refrigerant gas flows through the regenerator 7 as mentioned above is larger than the flow channel resistance when the refrigerant gas flows from the compressor 12 to the room-temperature chamber 8, the refrigerant gas within the room-temperature chamber 8 is compressed due to this flow channel resistance difference, and thereby, the temperature of the refrigerant gas within the room-temperature chamber 8 rises.

In the related art, since this high-temperature refrigerant gas flows into the regenerator 7, thermal efficiency declines. However, in the present embodiment, a decline in refrigeration efficiency is prevented by forming the first flow channel 11 in the displacer 2 and providing the clearance CL between the displacer 2 (displacer body 2A) and the cylinder 4 (top flange 4B). In addition, this will be described below in detail for convenience of description.

The high-pressure refrigerant gas that has flowed into the regenerator 7 flows into the expansion space 3 through the second flow channel 16 located below the displacer 2 while being cooled by the regenerative material. Then, if the expansion space 3 is filled with the high-pressure refrigerant gas and the displacer 2 reaches a top dead center or a predetermined position near the top dead center, the supply valve 13 is closed and the return valve 14 is opened. Thereby, the refrigerant gas expands adiabatically, and cooling is generated in the expansion space 3. The cooling generated in the expansion space 3 cools an object to be cooled via the cooling stage 5.

Subsequently, the displacer 2 moves toward a bottom dead center, and the volume of the expansion space 3 decreases. Along with this, the refrigerant gas within the expansion space 3 is returned to an intake side of the compressor 12 via the second flow channel 16, the regenerator 7, the first flow channel 11, and the room-temperature chamber 8. In that case, the regenerative material is cooled by the refrigerant gas. This process is defined as 1 cycle, and the cryogenic refrigerator 1A repeats this refrigeration cycle to cool the cooling stage 5.

Here, description will be made below while paying attention to the first flow channel 11 formed in the upper plate portion 2D of the displacer 2 and the clearance CL formed between the displacer body 2A and the top flange 4B.

In the present embodiment, the first flow channel 11 is L-shaped in a cross-sectional shape. Hence, an outer-peripheral-side end portion 11A of the first flow channel 11 is configured so as to open to the outer peripheral surface 28 of the displacer body 2A (displacer 2). That is, the outer-peripheral-side end portion 11A is configured so as to open to the clearance CL and face the heat transfer portion P1 of the top flange 4B. Additionally, an inner end portion 11B of the first flow channel 11 is configured so as to be connected to the regenerator 7.

The refrigerant gas that has flowed into the room-temperature chamber 8 as mentioned above is compressed within the room-temperature chamber 8, and temperature rises. The refrigerant gas whose temperature has risen flows into the first flow channel 11 (outer-peripheral-side end portion 11A) through the clearance CL.

In this case, since the refrigerant gas passes through the narrow clearance CL whose gap is about 0.1 mm to about 1.0 mm at a fast flow velocity, heat exchange is performed between the refrigerant gas and the heat transfer portion P1 of the top flange 4B and between the refrigerant gas and the top plate portion 2D of the displacer body 2A. That is, the heat of the refrigerant gas whose temperature has risen is transferred to the heat diffusion portion P2 via the heat transfer portion P1 of the top flange 4B, and is released to the outside in the heat diffusion portion P2. Additionally, the heat of the upper plate portion 2D whose temperature has risen is conducted to the displacer body 2A via the outer peripheral surface 28.

In this way, since heat exchange is performed between the refrigerant gas and the displacer body 2A and the top flange 4B, the refrigerant gas is cooled when passing through the clearance CL.

Accordingly, in the present embodiment, even if the temperature of the refrigerant gas rises in the room-temperature chamber 8, this refrigerant gas is cooled by passing through the clearance CL, and the refrigerant gas whose temperature has dropped is supplied to the regenerator 7. Thereby, even if the temperature of the refrigerant gas rises in the room-temperature chamber 8, the temperature of the refrigerant gas drops by passing through the clearance CL. Therefore, the temperature rise of the regenerative material of the regenerator 7 can be suppressed, and therefore, the cooling efficiency of the cryogenic refrigerator 1A can be enhanced.

In this case, the refrigerant gas that flows through the clearance CL performs heat exchange with the cylinder 4 and also performs heat exchange with the upper plate portion 2D. Thereby, although the temperature of the upper plate portion 2D rises, the heat of the upper plate portion 2D is heat-transferred to the top flange 4B via the clearance CL. Thereby, the temperature of the upper plate portion 2D drops, and therefore, the heat of the upper plate portion 2D can be prevented from affecting the regenerator 7.

In particular, influence on the regenerator 7 can be more effectively prevented by using materials having a larger heat conductivity than the material of the displacer body 2A as the material of the upper plate portion 2D.

Next, another embodiment of the invention will be described.

Figure 2:
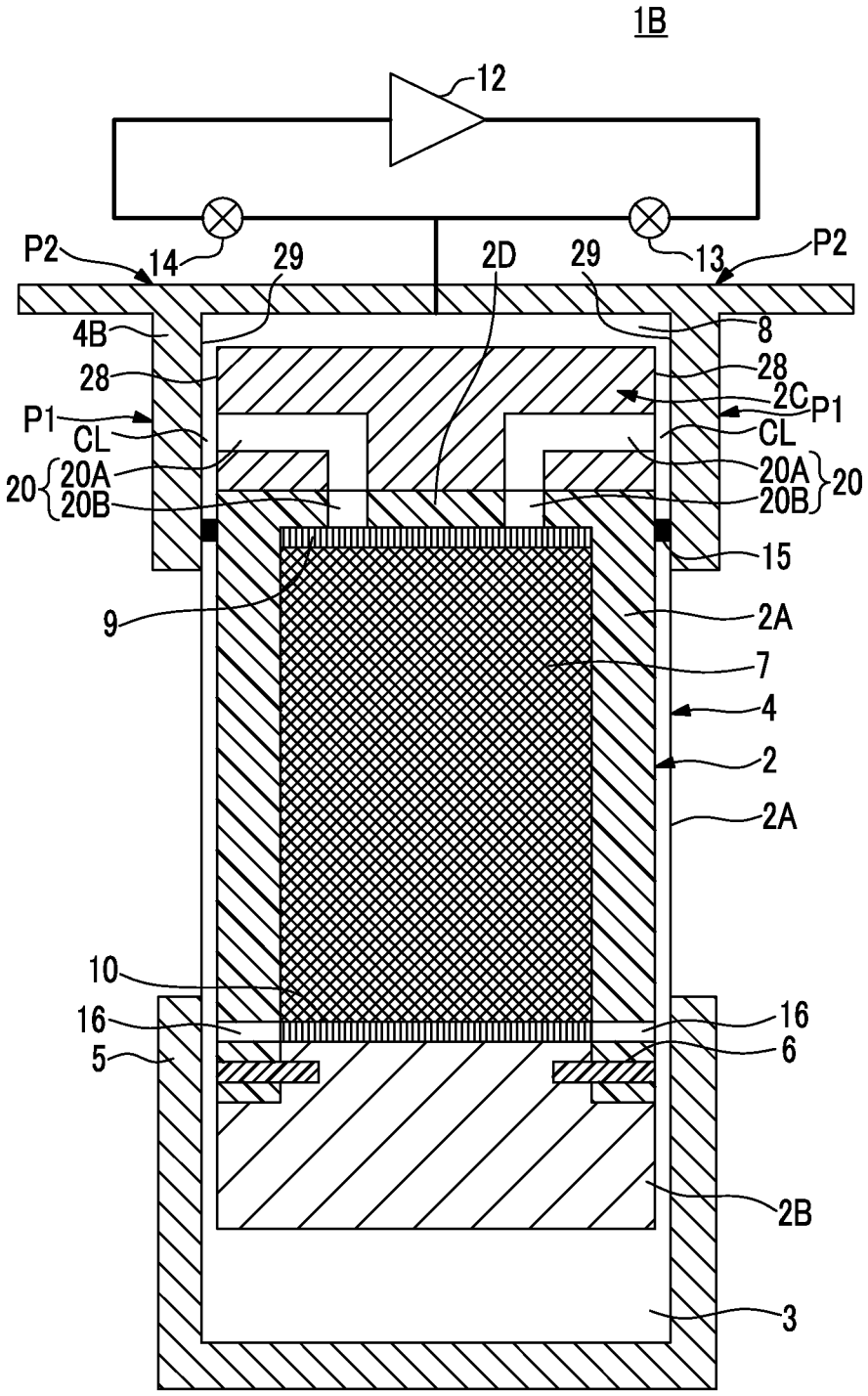
FIG. 2 is a cross-sectional view of a cryogenic refrigerator and a displacer according to another embodiment of the invention.

FIG. 2 shows a cryogenic refrigerator 1B related to another embodiment. In addition, in FIG. 2, constituents corresponding to the constituents shown in FIG. 1 are designated by the same reference numerals, and description thereof is omitted.

In the cryogenic refrigerator 1A related to the aforementioned embodiment, the displacer 2 is configured so as to have the displacer body 2A and the low-temperature-side heat conduction portion 2B, and the first flow channel 11 is configured so as to be formed in the upper plate portion 2D integrally formed on the side of the high-temperature end of the displacer body 2A.

In contrast, in the cryogenic refrigerator 1B related to the present embodiment, the displacer 2 is constituted by the displacer body 2A, the low-temperature-side heat conduction portion 2B, and a high-temperature-side heat conduction portion 2C, and a first flow channel 20 is formed on the high-temperature-side heat conduction portion 2C.

The high-temperature-side heat conduction portion 2C (equivalent to a heat conduction portion described in the claims) is arranged on the side of the high-temperature end of the displacer body 2A. Methods of fixing the high-temperature-side heat conduction portion 2C to the displacer body 2A are not particularly limited, and the high-temperature-side heat conduction portion can be fixed using well-known methods.

Specifically, a method of fixing the high-temperature-side heat conduction portion using a locking pin, which is not shown, and a method of forming an external thread and an internal thread in the displacer body 2A and the high-temperature-side heat conduction portion 2C and screwing the threads together, thereby fixing the high-temperature-side heat conduction portion, can be used.

The high-temperature-side heat conduction portion 2C is formed of materials that have heat conductivity equal to or higher than the heat conductivity of the displacer body 2A. As the specific materials of the high-temperature-side heat conduction portion 2C, for example, copper, aluminum, stainless steel, and the like can be used.

Additionally, the outer peripheral surface 28 of the high-temperature-side heat conduction portion 2C and the inner peripheral surface 29 (heat transfer portion P1) of the top flange 4B face each other, and the clearance CL is formed therebetween. The clearance CL is, for example, a gap of about 0.1 mm to about 1.0 mm, similar to the one embodiment. The first flow channel 20 is constituted by a conduction-portion-side flow channel 20A formed on the high-temperature-side heat conduction portion 2C, and a body-side flow channel 20B formed in the displacer body 2A.

The conduction-portion-side flow channel 20A is L-shaped in a cross-sectional shape, and is configured so that one end portion thereof opens to the outer peripheral surface 28 of the high-temperature-side heat conduction portion 2C. Additionally, the body-side flow channel 20B is formed in the upper plate portion 2D located at the high-temperature end of the displacer body 2A. A high-temperature-side end portion of the body-side flow channel 20B is connected to the other end portion of the conduction-portion-side flow channel 20A, and a low-temperature-side end portion thereof is connected to the regenerator 7.

Hence, in the present embodiment, the refrigerant gas whose temperature has risen within the room-temperature chamber 8 due to a resistance difference between the flow channel resistance of the refrigerant gas within the regenerator 7 and the flow channel resistance of the refrigerant gas when flowing from the compressor 12 into the room-temperature chamber 8, flows into the first flow channel 20 (conduction-portion-side flow channel 20A) through the clearance CL.

In this case, since the refrigerant gas passes through the narrow clearance CL at a fast flow velocity, heat exchange is performed between the refrigerant gas and the top flange 4B and between the refrigerant gas and the high-temperature-side heat conduction portion 2C. That is, the heat of the refrigerant gas whose temperature has risen is conducted to the top flange 4B via the inner peripheral surface 29, and is conducted to the high-temperature-side heat conduction portion 2C via the outer peripheral surface 28.

In the present embodiment, as described above, the heat conductivity of the high-temperature-side heat conduction portion 2C is set so as to be equal to or higher than the heat conductivity of the displacer body 2A. Hence, when heat exchange is performed between the refrigerant gas and the high-temperature-side heat conduction portion 2C, this heat exchange can be performed with higher efficiency.

Accordingly, according to the cryogenic refrigerator 1B related to the present embodiment, the cooling efficiency when the refrigerant gas passes through the clearance CL can be enhanced compared to the one embodiment. Additionally, the temperature rise of the regenerative material of the regenerator 7 can be more effectively suppressed by this, and the cooling efficiency of the cryogenic refrigerator 1B can be further enhanced.

Next, still another embodiment of the invention will be described.

Figure 3:
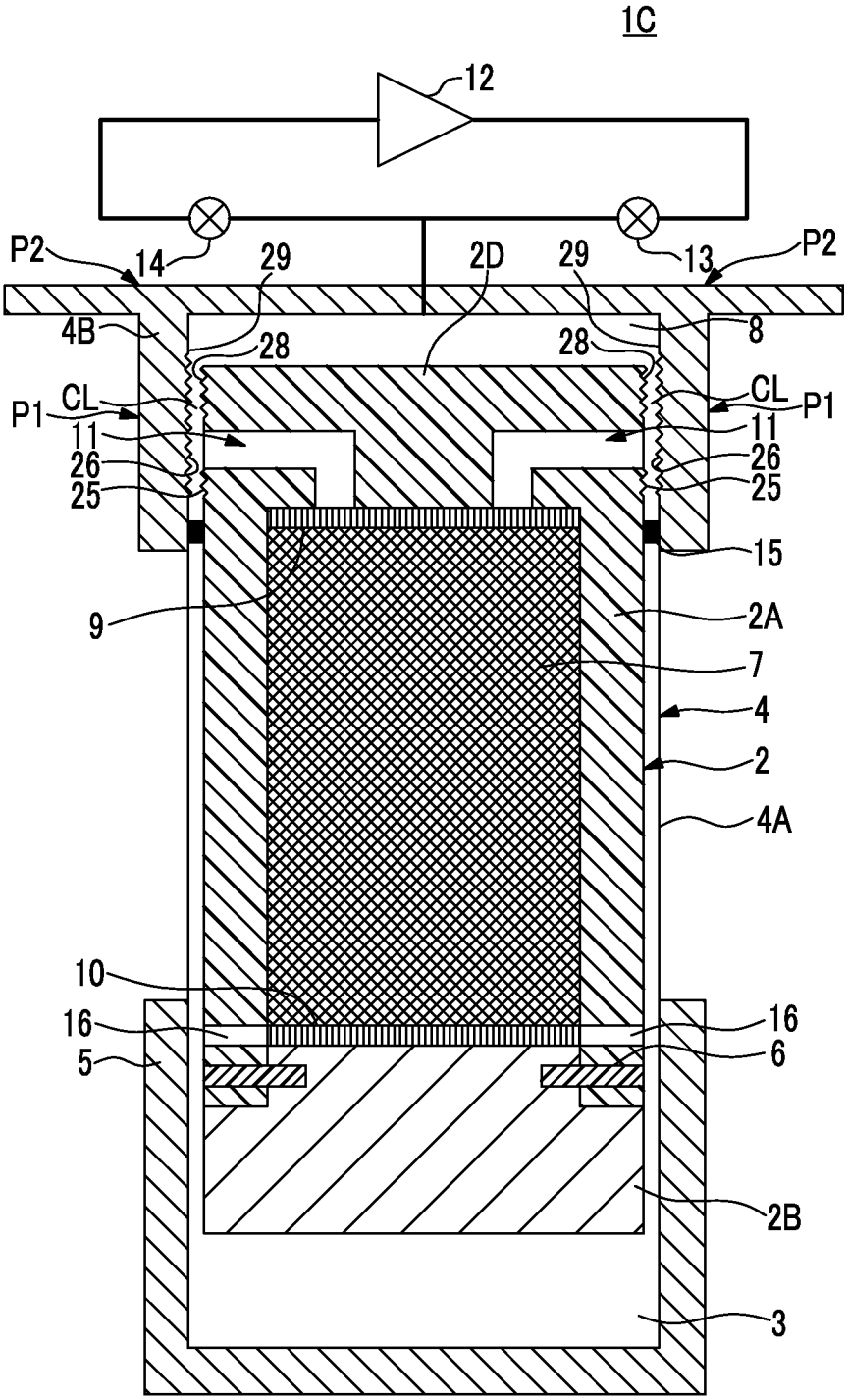
FIG. 3 is a cross-sectional view of a cryogenic refrigerator and a displacer according to still another embodiment of the invention.

FIG. 3 shows a cryogenic refrigerator 1C related to still another embodiment. In addition, in FIG. 3, constituents corresponding to the constituents shown in FIGS. 1 and 2 are designated by the same reference numerals, and description thereof is omitted.

In the cryogenic refrigerators 1A and 1B related to the aforementioned one and another embodiment, the outer peripheral surfaces 28 of the displacer body 2A and the high-temperature-side heat conduction portion 2C are formed as smooth surfaces, and similarly, the inner peripheral surface 29 of the top flange 4B is formed as a smooth surface.

In contrast, in the cryogenic refrigerator 1C related to the present embodiment, the outer peripheral surface 28 of the displacer body 2A (displacer 2) and the inner peripheral surface 29 of the top flange 4B (cylinder 4) that form the clearance CL are formed with concavo-convex portions 25 and 26 (equivalent to contact area increasing portions described in the claims) that increase the area of contact with the refrigerant gas. In the present embodiment, the concavo-convex portions are constituted by spiral grooves 25 and 26.

The spiral groove 25 is formed on the side of the high-temperature end of the outer peripheral surface 28 of the displacer body 2A, and the spiral groove 26 is formed further toward the high-temperature side (region including the heat transfer portion P1) than the arrangement position of the seal 15 arranged in the displacer 2 when the displacer 2 is located at the top dead center. Hence, in the cryogenic refrigerator 1C related to the present embodiment, the clearance CL is formed between the spiral groove 25 and the spiral groove 26.

Additionally, the formation range of the spiral groove 25 and the spiral groove 26 is set so as to have a range where the spiral groove 25 and the spiral groove 26 always face each other, in a movement range where the displacer 2 moves within the cylinder 4. In addition, the average separation distance between of the spiral groove 25 and the spiral groove 26 is about 0.1 mm to about 1.0 mm, similar to the one and another embodiment.

By forming the spiral grooves 25 and 26 in this way, the area of contact with the refrigerant gas can be increased, and thereby, the heat exchange efficiency when the refrigerant gas passes through the clearance CL can be enhanced. Hence, according to the cryogenic refrigerator 1C related to the present embodiment, heat exchange is performed with high efficiency between the refrigerant gas and the displacer 2 and between the refrigerant gas and the cylinder 4. Therefore, the refrigerant gas can be efficiently cooled. Thereby, the temperature rise of the regenerator 7 can be more effectively suppressed, and the refrigeration efficiency of the cryogenic refrigerator 1C can be enhanced.

In addition, in the above-described embodiment, the displacer 2 is formed with the spiral groove 25, and the cylinder 4 is also formed with the spiral groove 26. However, the spiral grooves are not necessarily formed in both of the displacer 2 and the cylinder 4, and a configuration in which a spiral groove is formed in any one can also be adopted.

Additionally, a configuration in which at least a portion of the displacer 2 constituted by the displacer body 2A and low-temperature-side heat conduction portion 2B is formed with the spiral groove 25 is shown in the above-described embodiment. However, in the displacer 2 constituted by the displacer body 2A, the low-temperature-side heat conduction portion 2B, and the high-temperature-side heat conduction portion 2C that are described in the another embodiment, at least a portion of the high-temperature-side heat conduction portion 2C can also be formed with the spiral groove 25.

Although the preferable embodiments of the invention have been described above in detail, the invention is not limited to the above-described specific embodiments, and various alterations and changes can be made within the scope of the invention described in the claims.

What is claimed is:

1. A single cooling stage cryogenic refrigerator comprising:

a displacer including a top plate, a cylindrical body, and a regenerative material stored inside of the displacer, the top plate having a flow channel that is configured to supply a refrigerant gas to a regenerator, the cylindrical body extending in an axial direction from the top plate; and a cylinder including a top wall, a lateral wall, and a cooling stage, the top wall positioned opposite the top plate, the lateral wall facing the cylindrical body, the cooling stage being provided at a bottom of the cylinder, the cylinder accommodating the displacer so as to be movable in the axial direction, and the cylinder containing a heat diffusion portion on the top wall, wherein a clearance is formed between an outer lateral surface of the top plate and an inner surface of the lateral wall, a first end portion of the flow channel opens to the clearance and a second end portion of the flow channel opens to the regenerator, the refrigerant gas within a space portion defined by the top wall, lateral wall and the top plate is configured to flow into the regenerator through the clearance and the flow channel, a seal is provided in the clearance formed between a lateral surface of the cylindrical body and the inner surface of the lateral wall, the heat diffusion portion is integrated with a top flange for fixing the top flange to the cylinder, and the lateral wall includes a heat transfer portion directly connected to the top flange and facing the lateral surface of the top plate via the clearance, so as to transfer heat from the refrigerant gas that flows through the clearance to the top flange.

2. The cryogenic refrigerator according to claim 1, wherein the top flange is made of a material having higher heat conductivity than the cylindrical body.

3. The cryogenic refrigerator according to claim 2, wherein the top plate is made of a material selected from copper, aluminum, and stainless steel.

4. The cryogenic refrigerator according to claim 1, wherein at least any one of the outer lateral surface of the top plate and the inner surface of the lateral wall is formed with a contact area increasing portion that increases the area of contact with the refrigerant gas.

5. The cryogenic refrigerator according to claim 4, wherein at least a portion of the contact area increasing portion includes a spiral groove.

6. The cryogenic refrigerator according to claim 1, wherein the lateral wall includes the heat transfer portion formed by making a thickness of the lateral wall larger than thicknesses at other portions, the heat transfer portion is provided at a position facing the clearance, and the heat transfer portion is directly connected to the heat diffusion portion.

7. The cryogenic refrigerator according to claim 1, wherein the heat transfer portion has a configuration in which a plate made of a material selected from copper, aluminum and stainless steel is wound around the outer periphery of the lateral wall, and the heat transfer portion is provided at a position adjacent the top wall with respect to the axis.

* * * * *